US005621513A

United States Patent [19]

Pitts et al.

[11] Patent Number: 5,621,513

[45] Date of Patent: Apr. 15, 1997

[54] ELECTRICALLY BIASED SHEET STRIPPING APPARATUS

[75] Inventors: Ian Pitts, Bassingbourne; John W. D. Cooper, Hitchin; Derek J. Milton, Welwyn Garden City, all of England

[73] Assignee: Xerox Corporation, Stamford, Conn.

[21] Appl. No.: 572,942

[22] Filed: Dec. 15, 1995

[30] Foreign Application Priority Data

Dec. 23, 1994 [GB] United Kingdom ..... 9426174

[51] Int. Cl.[6] ..... G03G 21/00

[52] U.S. Cl. ..... 399/398

[58] Field of Search ..... 355/271, 315; 271/900

[56] References Cited

U.S. PATENT DOCUMENTS

| | | | |
|---|---|---|---|
| 3,992,000 | 11/1976 | Martin | 271/174 |
| 4,017,065 | 4/1977 | Poehlein | 271/80 |
| 4,072,307 | 2/1978 | Knieser | 271/174 |

FOREIGN PATENT DOCUMENTS

| | | | |
|---|---|---|---|
| 0628886 | 12/1994 | European Pat. Off. | 355/315 |
| 59-125763 | 7/1984 | Japan | 355/315 |
| 60-125871 | 7/1985 | Japan . | |
| 61-026068 | 2/1986 | Japan | 355/315 |
| 63-125966 | 5/1988 | Japan . | |
| 1217382 | 8/1989 | Japan . | |
| 2-096787 | 4/1990 | Japan | 355/315 |
| 4-067183 | 3/1992 | Japan | 355/315 |
| 4-116581 | 4/1992 | Japan | 355/315 |

*Primary Examiner*—Robert Beatty
*Attorney, Agent, or Firm*—Denis A. Robitaille

[57] ABSTRACT

A sheet stripping device for stripping copy sheets from an arcuate imaging surface, including a support element and an electrically conductive stripping element coupled to an electrically biasing source. An electrical bias is applied to the stripping elements or fingers to suppress the build-up of toner on the stripping element so that large concentrations of toner are eliminated and minimal residue is left on the fingers as a thin film for preventing background contamination of the copy sheet.

9 Claims, 4 Drawing Sheets

ELECTRICALLY BIASED SHEET STRIPPING APPARATUS

The present invention relates generally to a sheet stripping apparatus, and more particularly to a sheet stripping apparatus having electrically biased stripper members.

In a typical sheet feeding apparatus located in, for example a copying or printing machine, it is generally necessary to effectively strip sheets from a previous transport element of the sheet feeding apparatus. Numerous techniques for accomplishing this task are known, including the use of mechanical stripper fingers.

For example, it is known in the electrostatographic arts to position a mechanical stripper finger closely adjacent the photoconductive imaging surface of a xerographic drum in order to catch the lead edge of a copy sheet emerging from the electrostatic transfer area, thereby initiating the stripping of the copy sheet away from the drum imaging surface (see U.S. Pat. No. 3,450,402 and U.S. Pat. No. 3,578,859 among other patents.) In addition, U.S. Pat. No. 3,992,000 addresses the problem of providing a stripper finger for use with an arcuate supporting surface such as a cylindrical photoreceptor wherein a pivotally mounted stripper element is used to maintain a desired close juxtaposition with the arcuate supporting surface.

A problem associated with stripper fingers for arcuate photoreceptors is that toner left on the photoreceptor after image transfer tends to gather on the tip of the stripper fingers. This causes undesirable effects where the sheet to be stripped has, for example, some upcurl present in it. JP-A-63-125966 discloses a sheet stripping device for a copying machine, including a separation claw made of a conductive material, wherein the claw includes an end for stripping sheets from a photoreceptor drum. The claw is connected to a DC voltage source via switch, for preventing toner from sticking to the claw. JP-A-1-217382 discloses a separation claw device fo a copying machine, in which a claw is held at a DC electrical potential so as to repel toner and further prevent toner in an unfused image from being attracted to the claw. JP-A-60-125871 discloses a transfer paper separating device, in which a projection plate engages a sheet at a curved section of a belt photoreceptor, thereby charging the sheet electrostatically and assisting in the separation of the sheet from the photoreceptor.

In the case of highlight color copying which is well known in the art, for example, a copy sheet passes through the transfer zone at least twice with the same side facing the same direction such that upcurl in the sheet on the first pass, induced by fusing as well as electrostatic tacking forces, causes the sheet to adopt a high trajectory path on subsequent passes, in particular post-transfer, such that the sheet strikes the stripper fingers. When the sheet hits the stripper fingers, toner may be transferred to the sheet by contact with a portion of the sheet extending back from the lead edge. This contamination may extend back 25 mm from the lead edge, creating background contamination which is unacceptable to a user. The problem is particularly acute when a large number of high area coverage copies are made such that the toner buildup on the fingers is large and concentrated at the tip.

The present invention provides a sheet stripping apparatus for stripping copy sheets from a surface of an imaging member, comprising: a support element, an electrically conductive stripping element mounted on the support element and having a stripping leading end, and electrical biasing means for applying an electrical bias having an AC component between the stripping element and the imaging member.

The electrical bias applied to the stripping elements or fingers suppresses the build-up of toner thereon and minimal residue is left on the fingers (as a thin film) such that large concentrations of toner on the stripper fingers are eliminated. This prevents the above-described background contamination of a copy sheet.

In specific embodiments, the stripping elements may comprise fingers formed of an insulating material coated with an electrically conductive material, such as conductive paint. Alternatively, the fingers may be formed of conductive plastic.

Preferably, the electrical biasing means comprises means for applying a predetermined AC bias and/or a predetermined DC bias, having a preferred biasing voltage of +500 to +1500 volts, however, suitable electrical bias levels depend on the charging characteristics of the imaging cartridge and the geometry of the system, and may be selected as necessary to adapt to a particular machine. The AC bias may have a frequency of up to about 600 Hz, and more preferably about 20 to 40 Hz with the AC biasing signal provided in the form of either a sine wave or square wave. The frequency of about 600 Hz may be a suitable acceptable signal as a signal with this frequency is often already available in a printing/copying machine.

In one particular embodiment, the electrical biasing means comprises means for applying a pulsed bias of (1) −1 kV DC for up to about 500 msec, followed by (2) 1 kV AC for up to about 100 msec. This may be even more effective since the DC bias retains a charge on the toner particles as the particles rest on the stripper finger while, the sudden change to 1 kV AC ensures maximum potential difference at switch over and therefore maximum repulsion of the toner from the finger.

Embodiments of the present invention will now be described, by way of example, with reference to the accompanying drawings, in which.

Figure 4:
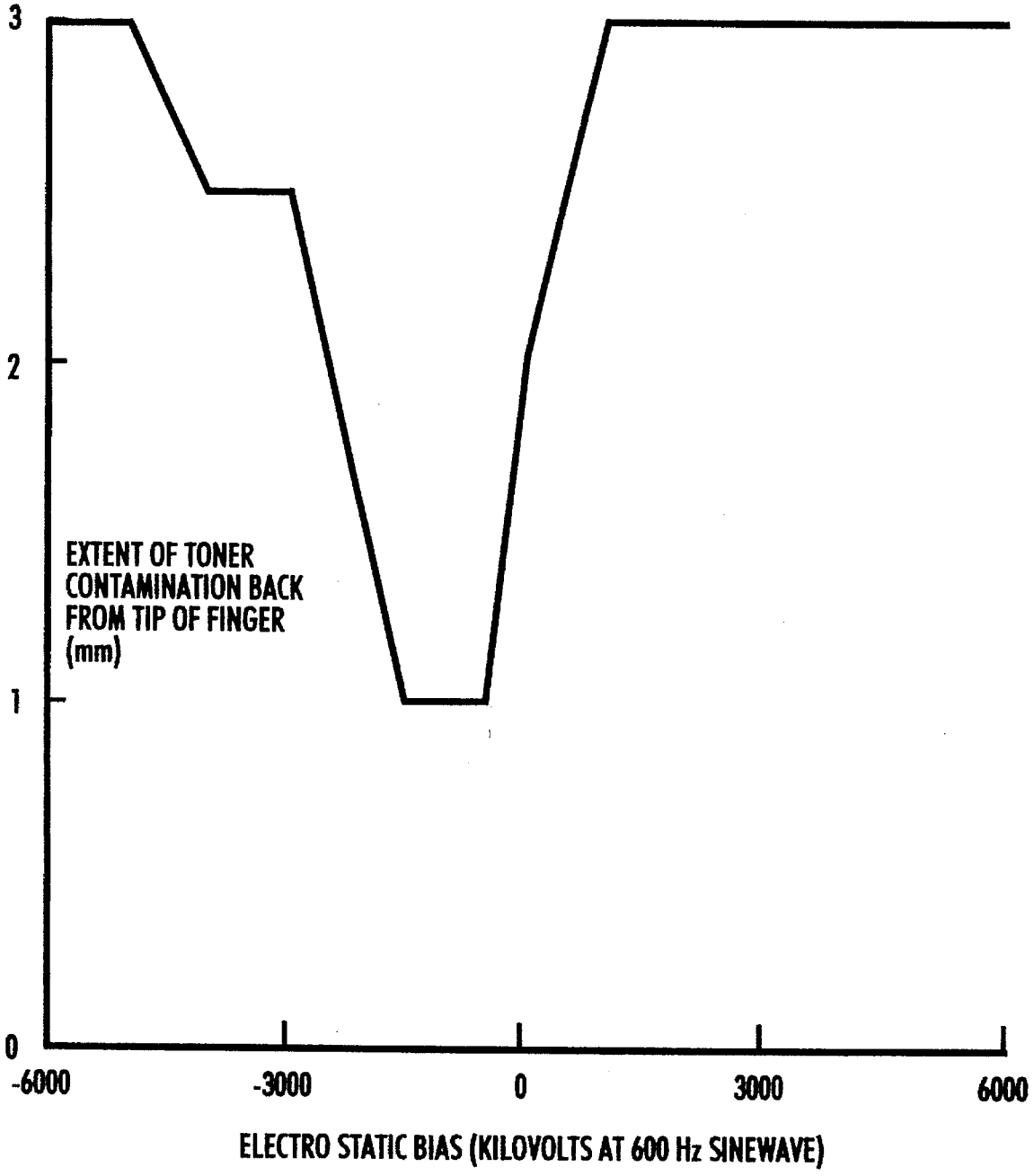

FIGS. 3(*a*) to 3(*d*) show exemplary voltage waveforms for the applied electrical bias in various embodiments of the invention; and FIG. 4 is a graph showing the extent of toner contamination on a stripper finger as a function of electrostatic bias.

While the present invention will hereinafter be described in connection with a preferred embodiment and method of use, it will be understood that this description is not intended to limit the invention to that embodiment or method of use. On the contrary, the following description is intended to cover all alternatives, modifications, and equivalents, as may be included within the spirit and scope of the invention as defined by the appended claims. Other aspects and features of the present invention will become apparent as the description progresses.

Figure 1:
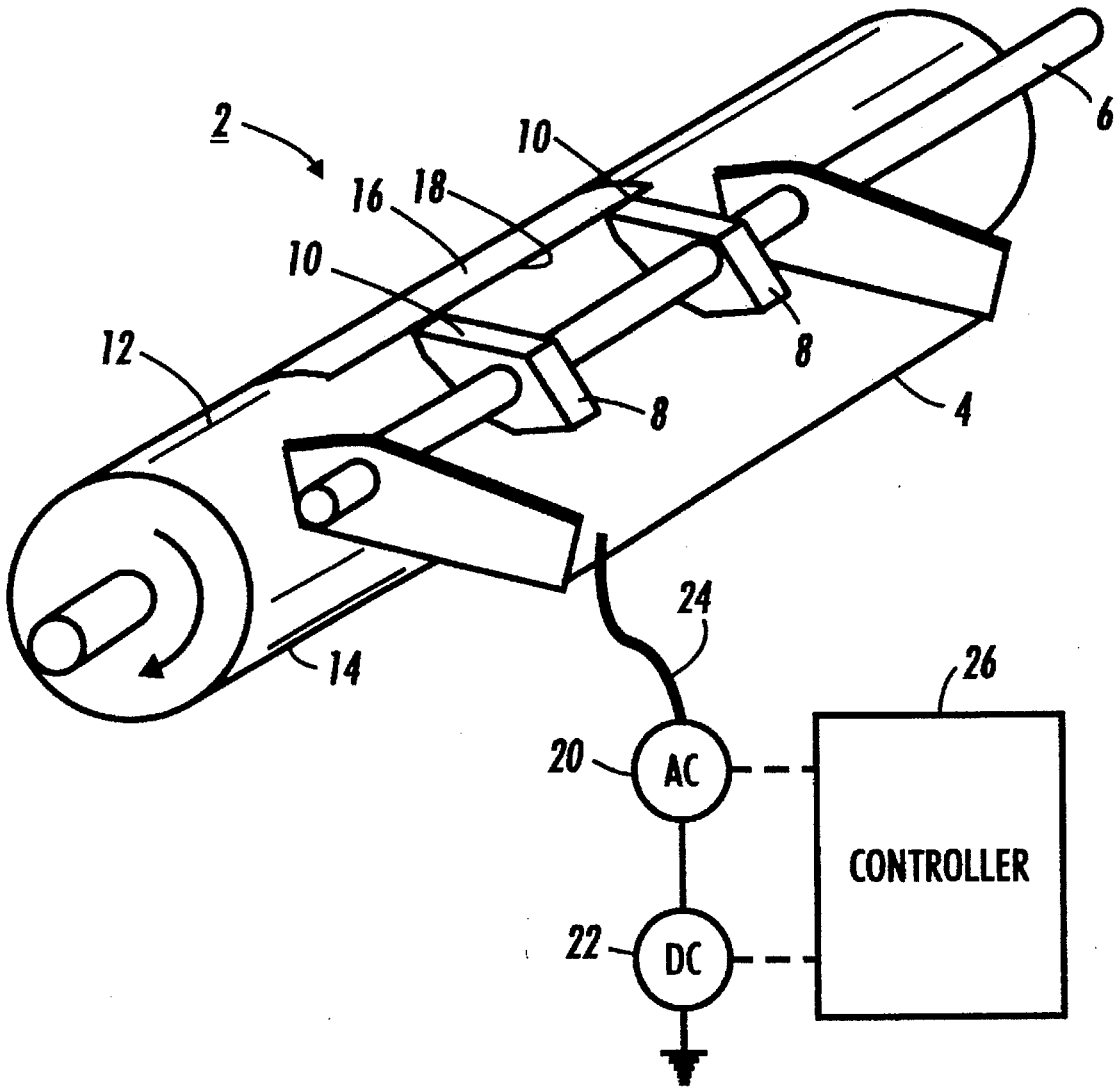
FIG. 1 is a perspective view of a sheet stripping apparatus in one embodiment of the present invention.

FIG. 1 shows schematically a sheet stripping apparatus in one embodiment of the present invention. The apparatus, generally designated by reference numberal 2, comprises a bracket 4 mounted on a shaft 6 which is rigidly fixed within the machine housing (not shown). The bracket 4 supports a plurality (in this case two) of stripping elements or fingers 8, which each have stripping edges 10. The stripping apparatus 2 is positioned such that the stripping edges 10 are adjacent and accurately spaced a predetermined distance from the surface 12 of a drum photoreceptor 14. The spacing may be of the order of 0.2 mm so that the stripping edges 10 cause stripping of the lead edge 18 of the sheet from the photoreceptor 14 upon contact therewith, when the drum which rotates continuously in the direction of arrow A, is carrying a copy sheet 16 to which a toner image has just been transferred.

In accordance with the instant invention, the bracket 4 and stripping elements 8 are electrically conductive. In the preferred embodiment, the stripping elements 8 are suitably made of conductive plastic, for example commercially available nylon based plastic containing 15% carbon particles and 20% PTFE dispersed therein. The plastic has sufficient conductivity while providing the further advantage of being self-lubricating, due to the presence of the PTFE. Alternatively, the stripping elements 8 may be formed on insulating plastic and coated with a conductive paint, such as commercially available air drying cellulose based paint containing silver particles dispersed therein.

An AC bias source 20 and a DC bias source 22 are connected to the bracket 4 by lead 24 with the state (ON/OFF) of the bias sources 20, 22 being determined by the machine controller 26. The controller 26 preferably comprises a microprocessor based controller, which is well known in the art, and which has typically been utilized to provide control of all of the major operations of the copying or printing machine in which the sheet stripping apparatus may be employed.

Figure 2:
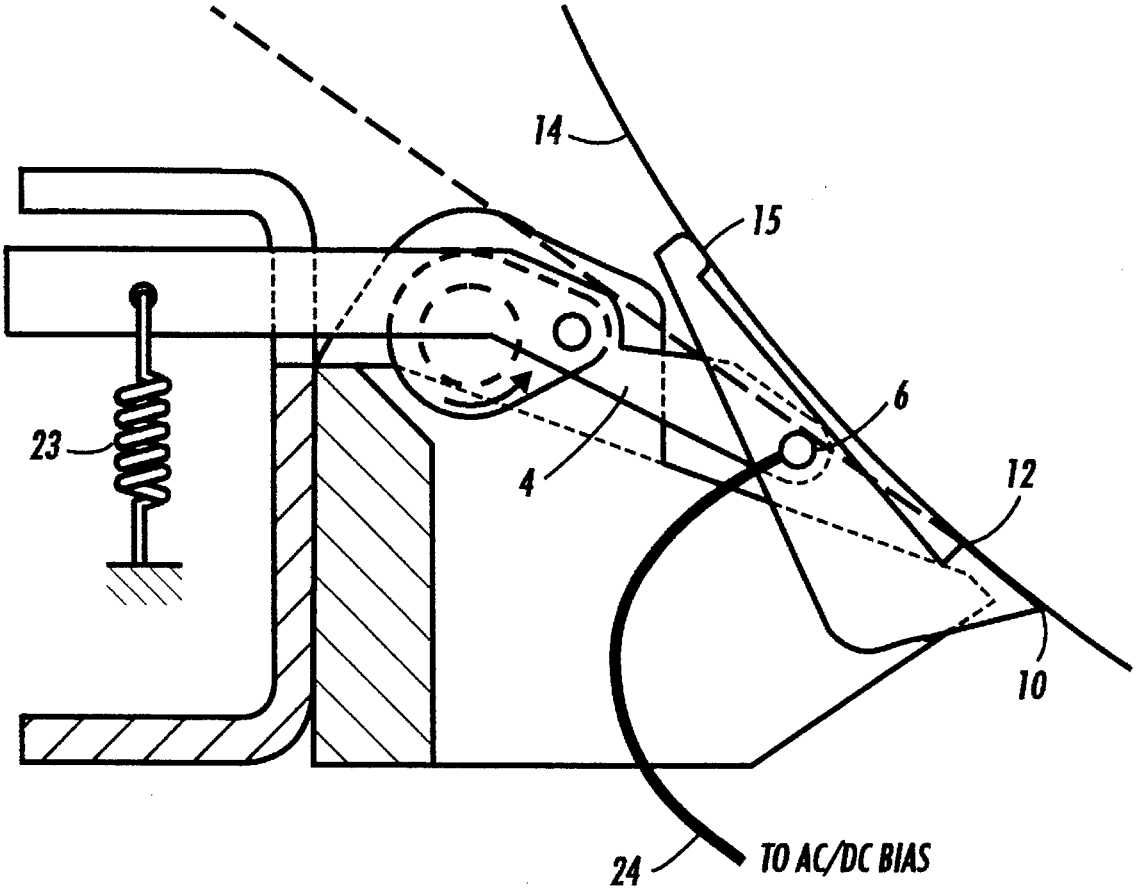
FIG. 2 is an elevational view showing a sheet stripping apparatus in a second embodiment of the present invention.
Figure 3A:
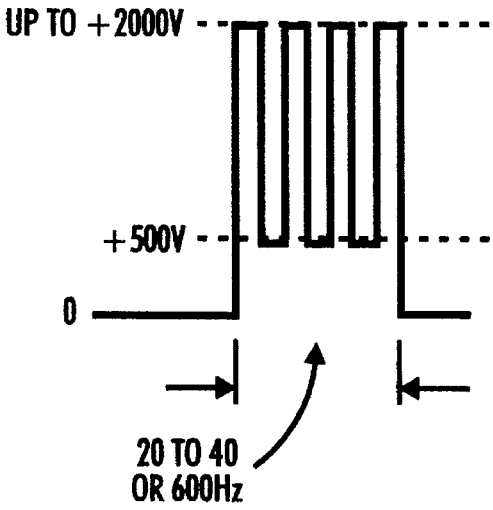
Figure 3B:
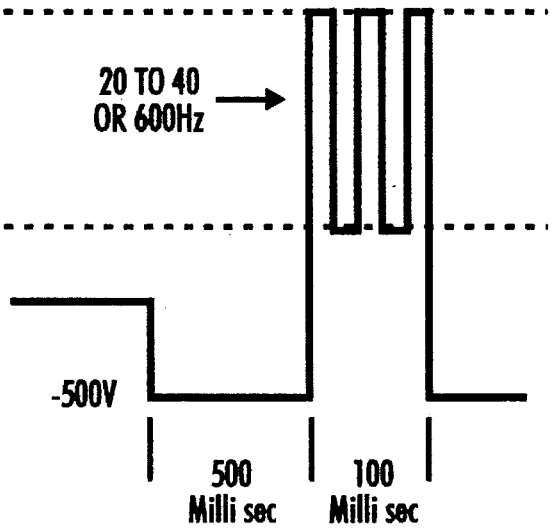
Figure 3C:
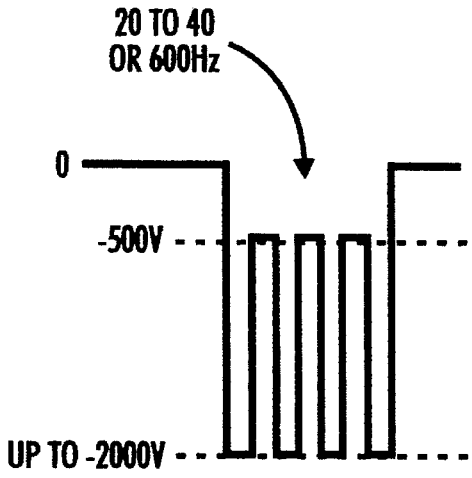
Figure 3D:
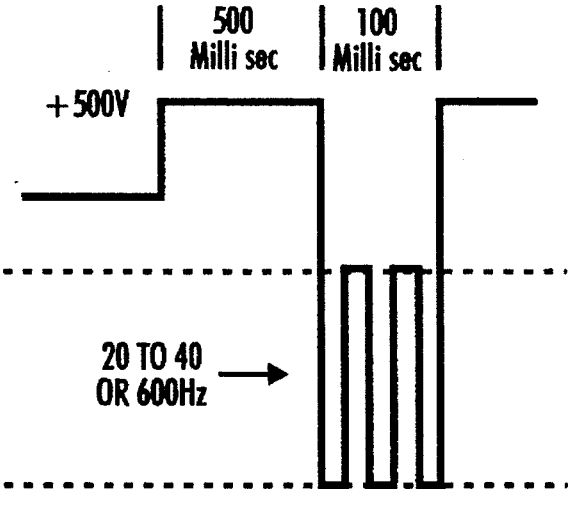

FIG. 2 shows a sheet stripping apparatus in a second embodiment of the present invention. The sheet stripping apparatus of this figure is exactly the same as the first embodiment (and like numerals have been used), except that a different configuration of stripper elements 8 are used. This stripping apparatus is described in more detail in previously referenced U.S. Pat. No. 3,992,000. The bias sources 20, 22 and controller 26 have been omitted for clarity.

FIGS. 3(*a*) to 3(*d*) show exemplary waveforms for the applied electrical bias in various embodiments of the invention, wherein FIGS. 3(*a*) and 3(*b*) show a positive voltage signal for use with a positive charged toner while FIGS. 3(*c*) and 3(*d*) show a negative voltage signal for use with a negatively charged toner. In each case, a square wave is illustrated, but it will be understood that a sinusoidal, triangular or sawtooth wave may used as an alternative.

The waveform for one embodiment is shown in FIG. 3(*a*). It can be seen that the bias comprises an AC voltage superposed on a DC level such that the lower level of the waveform may be +500V and the upper level of the waveform may be anything up to 2000V. A frequency for the AC component of about 20 to 40 Hz was found to work effectively. This frequency may, however, be up to about 600 Hz. This frequency gives some improvement in performance, and also brings the advantage that a 600 Hz signal is already available in certain copying machines, removing the need for separate signal generation circuitry. The waveform of FIG. 3(*a*) is maintained for the whole of the copy run made on the copying machine. Alternatively, another embodiment is shown in FIG. 3(*b*), wherein a DC bias of −500V is applied for 500 ms, and then the waveform of FIG. 3(*a*) is applied for 100 ms with this sequence being repeated for the duration of each copy run made on the copying machine. The waveforms for embodiments employed for negatively charged toner are shown in FIGS. 3(*c*) and 3(*d*). These waveform are the same as in the embodiments of FIGS. 3(*a*) and 3(*b*), except that they are the mirror image about the 0V axis.

FIG. 4 is a graph showing the extent of toner contamination on a stripper finger as a function of electrostatic bias. The extent of stripper finger contamination is expressed as the length of toner build up from the tip 10 of the fingers 8 in millimeters. The results are derived from using the stripping apparatus in a machine running 50% area coverage copies aligned to the fingers, with negatively charged toner. It will be seen from FIG. 4 that the contamination on the fingers is all but eliminated when using a bias of −500 to −2000 volts, with an AC component of 600 Hz.

In review, the present invention provides a sheet stripping device for stripping copy sheets and the like from an imaging surface or other transport surface. The stripping device includes an electrically conductive stripping element or finger and manes for electrically biasing the stripping element, wherein the electrical bias suppresses the build-up of toner particles on the stripping element to prevent background contamination of a copy sheet.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, the present invention is intended to embrace all such alternatives, modifications and variations as fall within the spirit and scope of the appended claims.

We claim:

1. A sheet stripping apparatus for stripping copy sheets from a surface of an imaging member, comprising:

a support element, an electrically conductive stripping element mounted on the support element and having a stripping leading end, and electrical biasing means for applying an electrical bias having an AC component between said stripping element and the imaging member, wherein the electrical biasing means includes means for applying an electrical bias of −1 kV DC for up to about 500 ms, followed by 1 kV AC superposed on +1 kV DC for up to about 100 ms.

2. An apparatus as claimed in claim 1, wherein the electrical biasing means includes an AC voltage source.

3. An apparatus as claimed in claim 2, wherein the electrical biasing means includes a DC voltage source.

4. An apparatus as claimed in claim 1, wherein the AC component has an amplitude of up to about 750 V.

5. An apparatus as claimed in claim 3, wherein the electrical biasing means is adapted to apply a DC bias of up to about 1250 V.

6. An apparatus as claimed in any of the preceding claims, wherein the AC component has a frequency of up to about 600 Hz.

7. An apparatus as claimed in claim 1, wherein the AC component has a frequency of about 20 to 40 Hz.

8. An apparatus as claimed in claim 1, wherein the AC component is a sine wave.

9. An apparatus as claimed in claim 1, wherein the AC component is a square wave.

* * * * *